US011101560B2

(12) United States Patent
Tai et al.

(10) Patent No.: US 11,101,560 B2
(45) Date of Patent: Aug. 24, 2021

(54) ANTENNA STRUCTURE

(71) Applicant: WISTRON NEWEB CORPORATION, Hsinchu (TW)

(72) Inventors: Chih-Feng Tai, Hsinchu (TW); Kuan-Hsun Lai, Hsinchu (TW); Kuei-Cheng Wang, Hsinchu (TW)

(73) Assignee: WISTRON NEWEB CORPORATION, Hsinchu Science Park (TW)

( * ) Notice: Subject to any disclaimer, the term of this patent is extended or adjusted under 35 U.S.C. 154(b) by 0 days.

(21) Appl. No.: 16/853,794

(22) Filed: Apr. 21, 2020

(65) Prior Publication Data

US 2021/0013607 A1 Jan. 14, 2021

(30) Foreign Application Priority Data

Jul. 12, 2019 (TW) ..... 108124731

(51) Int. Cl.
*H01Q 5/30* (2015.01)

(52) U.S. Cl.
CPC ..... *H01Q 5/30* (2015.01)

(58) Field of Classification Search
CPC ..... H01Q 5/30; H01Q 5/328; H01Q 5/335; H01Q 5/371; H01Q 5/378; H01Q 5/385; H01Q 5/392; H01Q 5/50; H01Q 1/241–243
See application file for complete search history.

(56) References Cited

U.S. PATENT DOCUMENTS 8,779,986 B2 * 7/2014 Fan ..... H01Q 9/42 343/700 MS
9,252,490 B2 2/2016 Wei
10,069,199 B2 * 9/2018 Chen ..... H01Q 1/38
2012/0001815 A1 * 1/2012 Wong ..... H01Q 9/0414 343/749

(Continued)

FOREIGN PATENT DOCUMENTS

CN 106299679 B 6/2019
TW 200905987 A 2/2009

(Continued)

*Primary Examiner* — Jason Crawford
(74) *Attorney, Agent, or Firm* — McClure, Qualey & Rodack, LLP

(57) ABSTRACT

An antenna structure is provided. The antenna structure includes a first radiation member, a second radiation member, and a feeding member. The first radiation member includes a first radiation portion, a second radiation portion, and a feeding portion electrically connected between the first radiation portion and the second radiation portion. The second radiation member includes a third radiation portion, a fourth radiation portion, and a grounding portion electrically connected between the third radiation portion and the fourth radiation portion. The third radiation portion and the first radiation portion are separate from and coupled to each other, the third radiation portion and the second radiation portion are separate from and coupled to each other, and the fourth radiation portion and the first radiation portion are separate from and coupled to each other. The feeding member is electrically connected between the feeding portion and the grounding portion.

14 Claims, 7 Drawing Sheets

(56) References Cited

U.S. PATENT DOCUMENTS

| | | | | |
|---|---|---|---|---|
| 2013/0207861 | A1* | 8/2013 | Huang | H01Q 13/10 343/767 |
| 2014/0361948 | A1* | 12/2014 | Tanaka | H01Q 1/38 343/861 |
| 2015/0200456 | A1* | 7/2015 | You | H01Q 5/321 343/722 |
| 2015/0236422 | A1* | 8/2015 | You | H01Q 5/378 343/729 |
| 2017/0005414 | A1* | 1/2017 | Yang | H01Q 5/378 |
| 2018/0048076 | A1* | 2/2018 | Wei | H01Q 9/045 |
| 2019/0044232 | A1* | 2/2019 | Tseng | H01Q 5/378 |
| 2019/0296446 | A1* | 9/2019 | Tseng | H01Q 9/42 |
| 2020/0021028 | A1* | 1/2020 | Wu | H01Q 1/526 |

FOREIGN PATENT DOCUMENTS

| | | |
|---|---|---|
| TW | I487195 B | 6/2015 |
| TW | I524594 B | 3/2016 |

* cited by examiner

ANTENNA STRUCTURE

CROSS-REFERENCE TO RELATED PATENT APPLICATION

This application claims the benefit of priority to Taiwan Patent Application No. 108124731, filed on Jul. 12, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and in particular, to an antenna structure that has an operating frequency band applied to a fourth generation mobile communications technology and a fifth generation mobile communications technology.

BACKGROUND OF THE DISCLOSURE

With the development of fifth generation mobile communications technologies (5th Generation Mobile Networks, 5G), an existing antenna structure design cannot satisfy an operating frequency band in a fifth generation communications system. Generally, to further support a 5G operating frequency band, an antenna that supports the 5G operating frequency band is additionally added to all existing products. However, when all the existing products are designed to be miniaturized, it is difficult to have a surplus space for additionally disposing a 5G antenna.

Therefore, in view of the above, how an antenna structure design can be improved to overcome the foregoing defect has become one of important issues to be resolved in the related field.

SUMMARY OF THE DISCLOSURE

In response to the above-referenced technical inadequacies, the present disclosure provides an antenna structure that has an operating frequency band applied to a fourth generation mobile communications technology and a fifth generation mobile communications technology.

To resolve the foregoing technical problem, a technical solution adopted in the present disclosure is to provide an antenna structure, including: a first radiation member, a second radiation member, and a feeding member. The first radiation member includes a first radiation portion, a second radiation portion, and a feeding portion electrically connected between the first radiation portion and the second radiation portion. The second radiation member includes a third radiation portion, a fourth radiation portion, and a grounding portion electrically connected between the third radiation portion and the fourth radiation portion. The third radiation portion and the first radiation portion are separate from and coupled to each other, the third radiation portion and the second radiation portion are separate from and coupled to each other, and the fourth radiation portion and the first radiation portion are separate from and coupled to each other. The feeding member is electrically connected between the feeding portion and the grounding portion.

A beneficial effect of the present disclosure resides in that, in the antenna structure provided in the present disclosure, by virtue of "the fourth radiation portion and the first radiation portion are separate from and coupled to each other", an operating frequency band capable of being applied to the fifth generation mobile communications technology can be provided.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
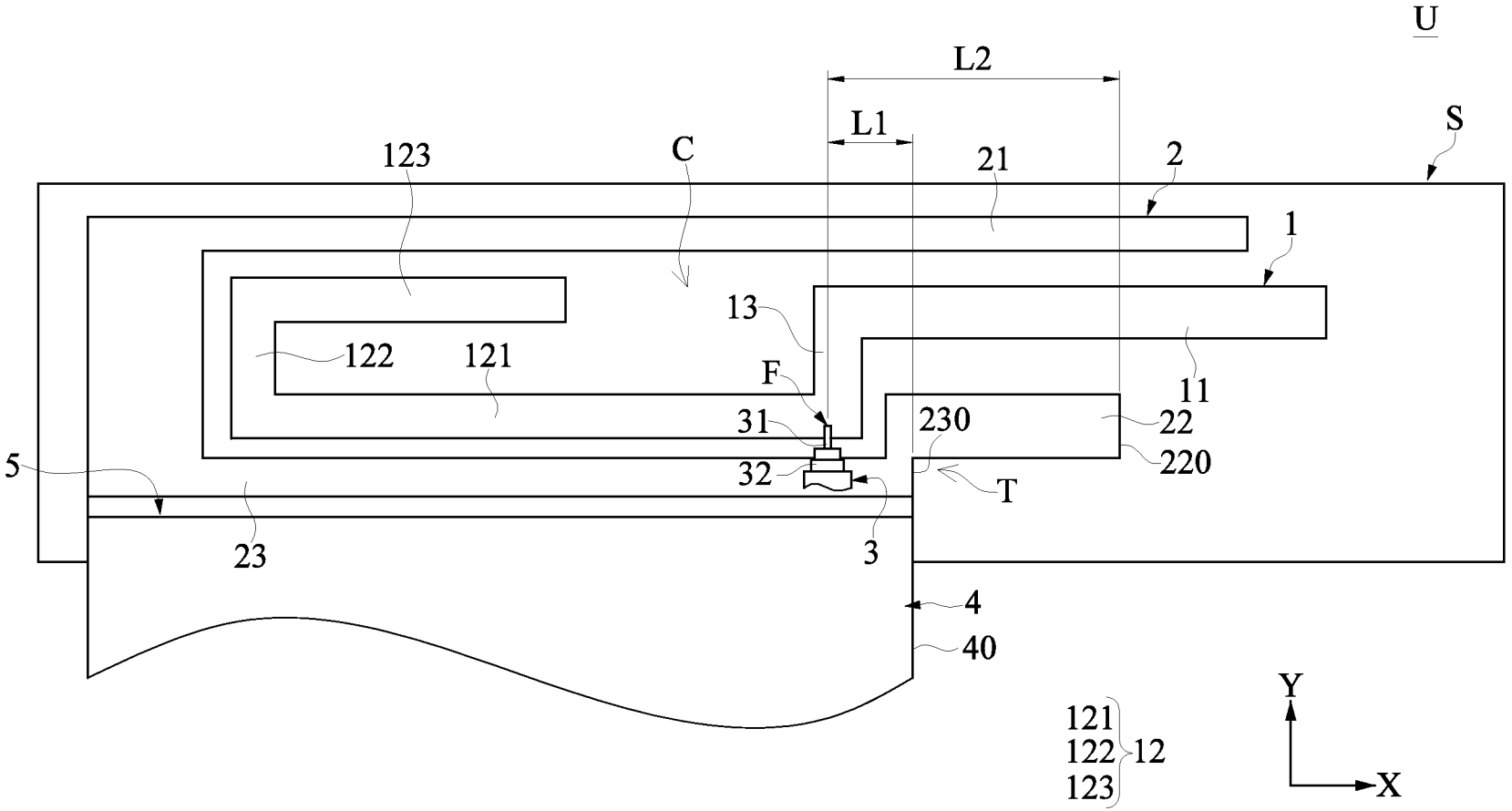
FIG. 1 is a schematic top view of an antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

First, FIG. 1 is a schematic top view of an antenna structure according to a first embodiment of the present disclosure. The first embodiment of the present disclosure provides an antenna structure U, including: a first radiation member 1, a second radiation member 2, and a feeding member 3. In addition, the antenna structure U may further include a substrate S, the first radiation member 1 and the second radiation member 2 may be disposed on the substrate S, and the feeding member 3 may be electrically connected between the first radiation member 1 and the second radiation member 2. For example, the first radiation member 1 and the second radiation member 2 each may be a metal sheet, a metal conducting wire, or another electrical conductor having a conductive effect, and the feeding member 3 may be a coaxial cable, but the present disclosure is not limited thereto. In addition, the feeding member 3 may have a feeding end 31 and a grounding end 32, the feeding end 31 may be electrically connected to the first radiation member 1, and the grounding end 32 may be electrically connected to the second radiation member 2. Moreover, it should be particularly noted that, the term "connect" refers to a physical connection that may be a direct or indirect connection between two components, and the term "couple" refers to a non-physical connection between two components, which may occur as a result of electric field energy from one component being excited by electric field energy of another component, said electric field energy being generated by electric currents of the components.

Based on the above, the antenna structure U may further include a grounding member 4, and the grounding member 4 may be electrically connected to the second radiation member 2. In addition, in a preferable implementation, the antenna structure U may further include a bridge member 5, and the bridge member 5 may be electrically connected between the second radiation member 2 and the grounding member 4. It should be noted that the bridge member 5 is disposed to enable the grounding member 4 to be easily connected to the second radiation member 2. Although, as described in an implementation in FIG. 1, the bridge member 5 may be further disposed, in other implementations, the bridge member 5 may alternatively not be disposed. In addition, it should be noted that, for example, a material of the bridge member 5 may be tin or other conductive materials, and a material of the grounding member 4 may be copper or other conductive materials, but the present disclosure is not limited thereto.

Then, the first radiation member 1 may include a first radiation portion 11, a second radiation portion 12, and a feeding portion 13 electrically connected between the first radiation portion 11 and the second radiation portion 12. The second radiation member 2 may include a third radiation portion 21, a fourth radiation portion 22, and a grounding portion 23 electrically connected between the third radiation portion 21 and the fourth radiation portion 22. The feeding member 3 may be electrically connected between the feeding portion 13 and the grounding portion 23, the feeding end 31 of the feeding member 3 may be electrically connected to the feeding portion 13, and the grounding end 32 of the feeding member 3 is electrically connected to the grounding portion 23. In addition, the grounding member 4 may be electrically connected to the grounding portion 23 of the second radiation member 2, and preferably, the bridge member 5 may be used to enable the grounding member 4 and the grounding portion 23 to be connected to each other.

Based on the above, the first radiation portion 11 may extend toward a first direction (a positive X direction) relative to the feeding portion 13, and the second radiation portion 12 may extend toward a second direction (a negative X direction) relative to the feeding portion 13. In other words, the first radiation portion 11 may be disposed on one side (for example, but not limited to, a right side) of the feeding portion 13, and the second radiation portion 12 may be disposed on the other side (for example, but not limited to, a left side) of the feeding portion 13, but the present disclosure is not limited thereto. In addition, the third radiation portion 21, the grounding portion 23, and the fourth radiation portion 22 are capable of forming a surrounding region C, and the first radiation member 1 is disposed in the surrounding region C. For example, the surrounding region C may be similar to a "C"-shaped pattern, and a space of the "C"-shaped pattern may surround three side edges of the first radiation member 1, but the present disclosure is not limited thereto.

Then, the second radiation portion 12 may include a first radiation body 121 electrically connected to the feeding portion 13, a second radiation body 122 electrically connected to the first radiation body 121 and bent relative to the first radiation body 121, and a third radiation body 123 electrically connected to the second radiation body 122 and bent relative to the second radiation body 122. The first radiation portion 11 may extend toward the first direction (the positive X direction) relative to the feeding portion 13. In addition, the first radiation body 121 of the second radiation portion 12 may extend toward the second direction (the negative X direction) relative to the feeding portion 13, the second radiation body 122 of the second radiation portion 12 may extend toward a third direction (a positive Y direction) relative to the first radiation body 121, and the third radiation body 123 of the second radiation portion 12 may extend toward the first direction (the positive X direction) relative to the second radiation body 122. In addition, the fourth radiation portion 22 may be electrically connected to the grounding portion 23 and extend toward the first direction (the positive X direction) relative to the feeding portion 13. In terms of the present disclosure, the first direction, the second direction, and the third direction may be different from one another. In other words, the first direction and the second direction may be opposite to each other, the first direction and the third direction are perpendicular to each other, and the second direction and the third direction are perpendicular to each other.

Then, a connection position between the feeding end 31 of the feeding member 3 and the feeding portion 13 may be defined as a feeding position F, a first predetermined distance L1 may exist between the feeding position F and an edge 230 of the grounding portion 23, and a second predetermined distance L2 may exist between the feeding position F and an edge 220 of the fourth radiation portion 22, where the second predetermined distance L2 is greater than the first predetermined distance L1. In other words, the first predetermined distance L1 and the second predetermined distance L2 are distances measured by using the feeding position F as a baseline toward the first direction (the positive X direction). Further, in an implementation, a groove T may be formed at a connection position between the fourth radiation portion 22 and the grounding portion 23. In addition, a step exists between the fourth radiation portion 22 and the grounding portion 23, that is, a high and low position difference exists between the fourth radiation portion 22 and the grounding portion 23 in the third direction (the positive Y direction). In addition, it should be noted that, in other implementations, a first predetermined distance L1 may exist between the feeding position F and an edge 40 of the grounding member 4, and a second predetermined distance L2 may exist between the feeding position F and an edge 220 of the fourth radiation portion 22, where the second predetermined distance L2 may be greater than the first predetermined distance L1.

Then, referring to FIG. 1 again, in terms of the present disclosure, the third radiation portion 21 and the first radiation portion 11 may be separate from and coupled to each other, and the third radiation portion 21 and the second radiation portion 12 may be separate from and coupled to each other, to generate an operating frequency band having a frequency range between 698 MHz and 960 MHz. In addition, the first radiation portion 11 is capable of generating an operating frequency band having a frequency range between 1,450 MHz and 2,300 MHz. In addition, the second radiation portion 12 is capable of generating an operating frequency band having a frequency range between 2,300 MHz and 2,700 MHz. In addition, the fourth radiation portion 22 and the first radiation portion 11 may be separate from and coupled to each other, to generate an operating frequency band having a frequency range between 3,300 MHz and 3,800 MHz. Further, the first radiation portion 11 may generate an operating frequency band having a frequency range between 5,100 MHz and 5,850 MHz through frequency multiplication. In addition, when the second radiation portion 12 and the third radiation portion 21 are separate from and coupled to each other, an operating frequency band having a frequency range between 4,600 MHz and 5,400 MHz may further be generated through frequency multiplication.

Second Embodiment

Figure 2:
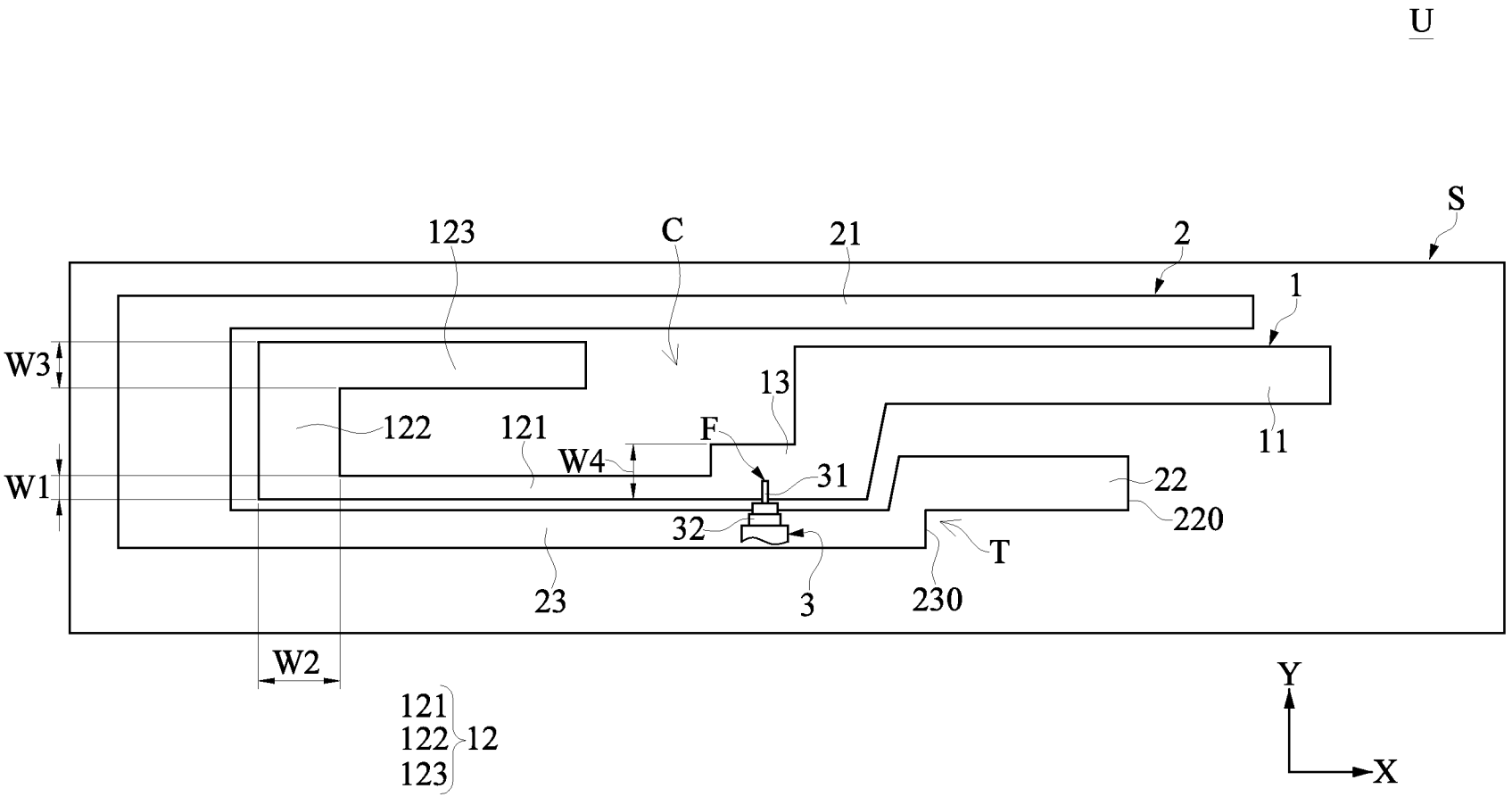
FIG. 2 is a schematic top view of an antenna structure according to a second embodiment of the present disclosure.

First, FIG. 2 is a schematic top view of an antenna structure according to a second embodiment of the present disclosure. As shown by a comparison between FIG. 2 and FIG. 1, a greatest difference between the second embodiment and the first embodiment lies in that a structure of the first radiation member 1 of the antenna structure U provided in the second embodiment may be adjusted, to further improve overall performance of the antenna structure U. In addition, it should be noted that other structural features shown in the second embodiment are similar to those described in the foregoing embodiment, and details are not described herein again. In addition, for brevity of illustration, the grounding member 4 and the bridge member 5 are omitted.

Based on the above, the first radiation body 121 may have a first predetermined width W1, the second radiation body 122 may have a second predetermined width W2, and the third radiation body 123 may have a third predetermined width W3, where the second predetermined width W2 may be greater than the third predetermined width W3, and the third predetermined width W3 may be greater than the first predetermined width W1. In addition, the feeding portion 13 may have a fourth predetermined width W4, and the fourth predetermined width W4 may be greater than the first predetermined width W1. Therefore, compared with a case in which the first predetermined width W1 of the first radiation body 121, the second predetermined width W2 of the second radiation body 122, and the third predetermined width W3 of the third radiation body 123 are the same in the first embodiment, in the antenna structure U provided in the second embodiment, a bandwidth of an operating frequency band that is generated by the antenna structure U and that has a frequency range between 4,600 MHz and 5,400 MHz can be increased, and radiation efficiency can be improved. Further, in terms of the first embodiment, in the operating frequency band that is generated by the antenna structure U and that has a frequency range between 4,600 MHz and 5,400 MHz, only an operating frequency band between 4,600 MHz and 4,800 MHz has relatively good radiation efficiency. However, in terms of the second embodiment, the entire operating frequency band that is generated by the antenna structure U and that has a frequency range between 4,600 MHz and 5,400 MHz has relatively good radiation efficiency.

Third Embodiment

Figure 3:
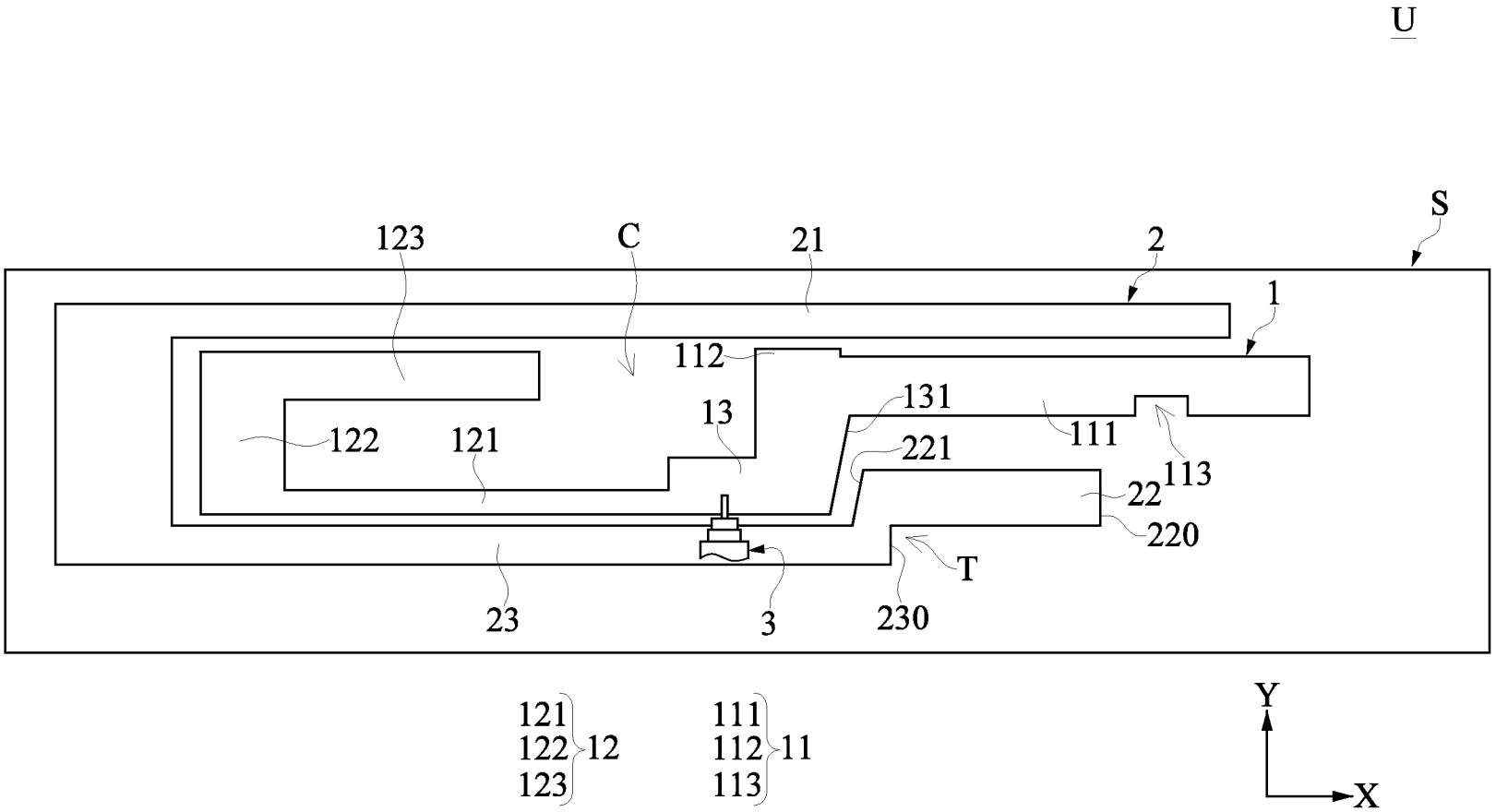
FIG. 3 is a schematic top view of an antenna structure according to a third embodiment of the present disclosure.

First, FIG. 3 is a schematic top view of an antenna structure according to a third embodiment of the present disclosure. As shown by a comparison between FIG. 3 and FIG. 2, a greatest difference between the third embodiment and the second embodiment lies in that a structure of the first radiation member 1 of the antenna structure U provided in the third embodiment may be adjusted, to further improve overall performance of the antenna structure U. In addition, it should be noted that other structural features shown in the third embodiment are similar to those described in the foregoing embodiments, and details are not described herein again.

Based on the above, the first radiation portion 11 may include a first body 111 electrically connected to the feeding portion 13, a first protruding body 112 electrically connected to the first body 111 and protruding toward the third radiation portion 21, and a first groove body 113 recessed relative to the first body 111. In addition, the first body 111 of the first radiation portion 11 may extend toward a first direction (a positive X direction) relative to the feeding portion 13, the first protruding body 112 may extend toward a third direction (a positive Y direction), and the first groove body 113 may be recessed toward the third direction (the Y direction). Further, in the first direction, a distance between the first protruding body 112 and the feeding position F is less than a distance between the first groove body 113 and the feeding position F, in other words, the first protruding body 112 is closer to the feeding position F than the first groove body 113. Moreover, a center frequency of an operating frequency band that is generated by the first radiation portion 11 and that has a frequency range between 5,100 MHz and 5,850 MHz may be adjusted by disposing the first protruding body 112. Therefore, compared with a case in which no first protruding body 112 is disposed in the antenna structure U in the second embodiment, in the antenna structure U provided in the third embodiment, the center frequency of the operating frequency band having a frequency range between 5,100 MHz and 5,850 MHz can be adjusted. In addition, a bandwidth of an operating frequency band having a frequency range between 1,450 MHz and 2,300 MHz and a bandwidth of the operating frequency band having a frequency range between 5,100 MHz and 5,850 MHz may be adjusted by disposing the first groove body 113.

Based on the above, the feeding portion 13 may have a bevel edge 131, and the fourth radiation portion 22 may have a bevel edge 221, where the bevel edge 131 of the feeding portion 13 is opposite to and in parallel with the bevel edge 221 of the fourth radiation portion 22. In addition, the center frequency of the operating frequency band having a frequency range between 1,450 MHz and 2,300 MHz and a bandwidth of an operating frequency band having a frequency range between 3,300 MHz and 3,800 MHz may be adjusted by disposing the bevel edge 131 of the feeding portion 13.

Fourth Embodiment

Figure 4:
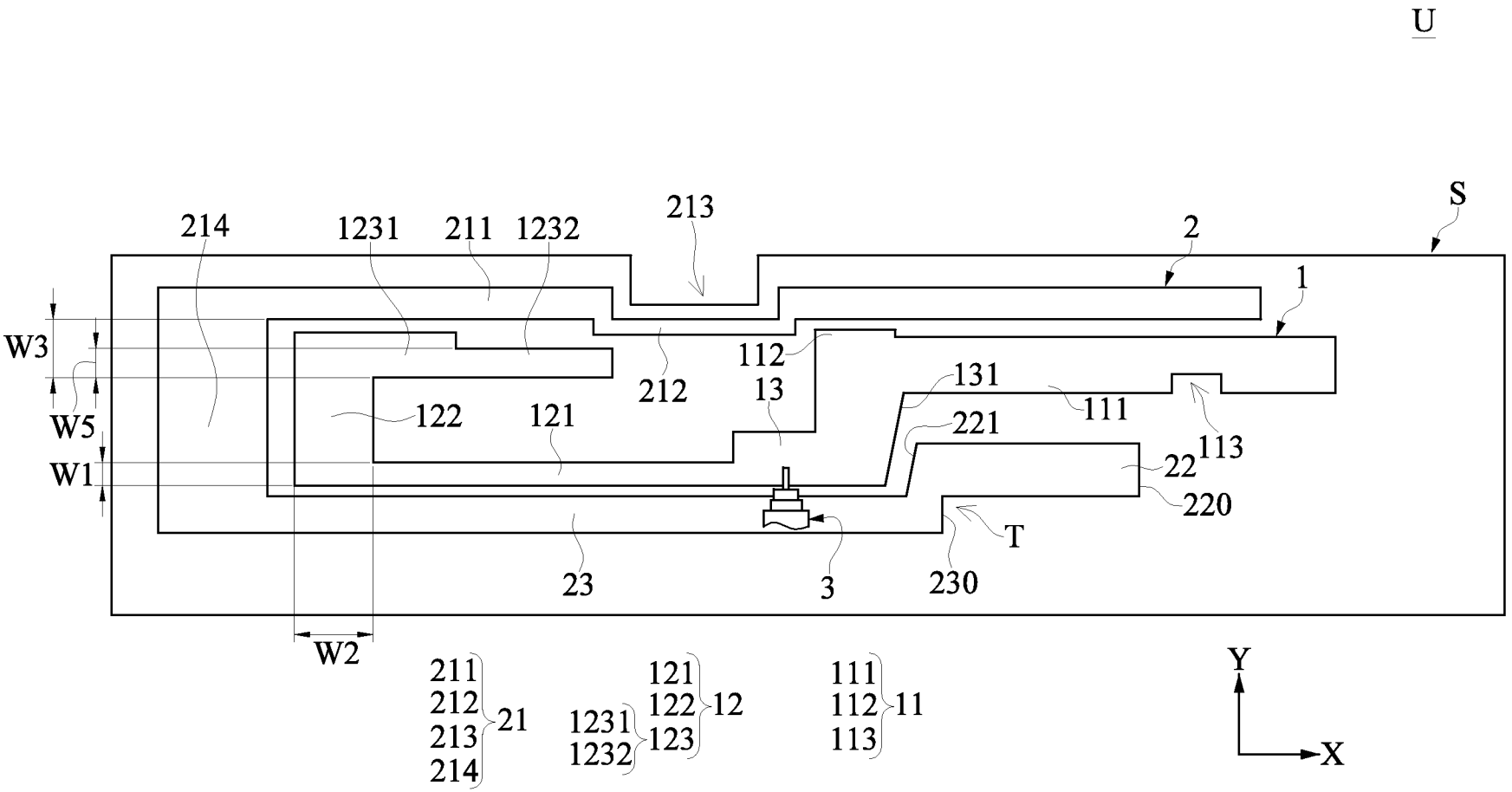
FIG. 4 is a schematic top view of an antenna structure according to a fourth embodiment of the present disclosure.

First, FIG. 4 is a schematic top view of an antenna structure according to a fourth embodiment of the present disclosure. As shown by a comparison between FIG. 4 and FIG. 3 that, a greatest difference between the fourth embodiment and the third embodiment lies in that due to space constraints of some disposition positions of the antenna structure U, a periphery structure of the antenna structure U in the fourth embodiment may be adjusted according to the space constraints, to improve overall performance of the antenna structure U. In addition, it should be noted that other structural features shown in the fourth embodiment are similar to those described in the foregoing embodiments, and details are not described herein again.

Based on the above, the third radiation portion 21 of the antenna structure U provided in the fourth embodiment may include a second body 211, a connection body 214 connected between the second body 211 and the grounding portion 23, a second protruding body 212 electrically connected to the second body 211 and protruding toward a direction of the second radiation portion 12, and a second groove body 213 recessed relative to the second body 211 and corresponding to the second protruding body 212. In addition, the second protruding body 212 may be disposed at a position corresponding to the second groove body 213, the second protruding body 212 may extend toward a fourth direction (a negative Y direction), and the second groove body 213 may be recessed toward the fourth direction (the negative Y direction). In addition, it should be noted that a shape of the third radiation body 123 of the second radiation portion 12 should also be adjusted accordingly because the second protruding body 212 further extends toward the direction of the second radiation portion 12 relative to the second body 211. Further, the third radiation body 123 may include a first section 1231 connected to the second radiation body 122 and a second section 1232 connected to the first section 1231. The first section 1231 may have a third predetermined width W3, and the second section 1232 may have a fifth predetermined width W5, where the third predetermined width W3 is greater than the fifth predetermined width W5. Further, the second predetermined width W2 may be greater than the third predetermined width W3, and the second predetermined width W2 may be greater than the fifth predetermined width W5.

Figure 5:
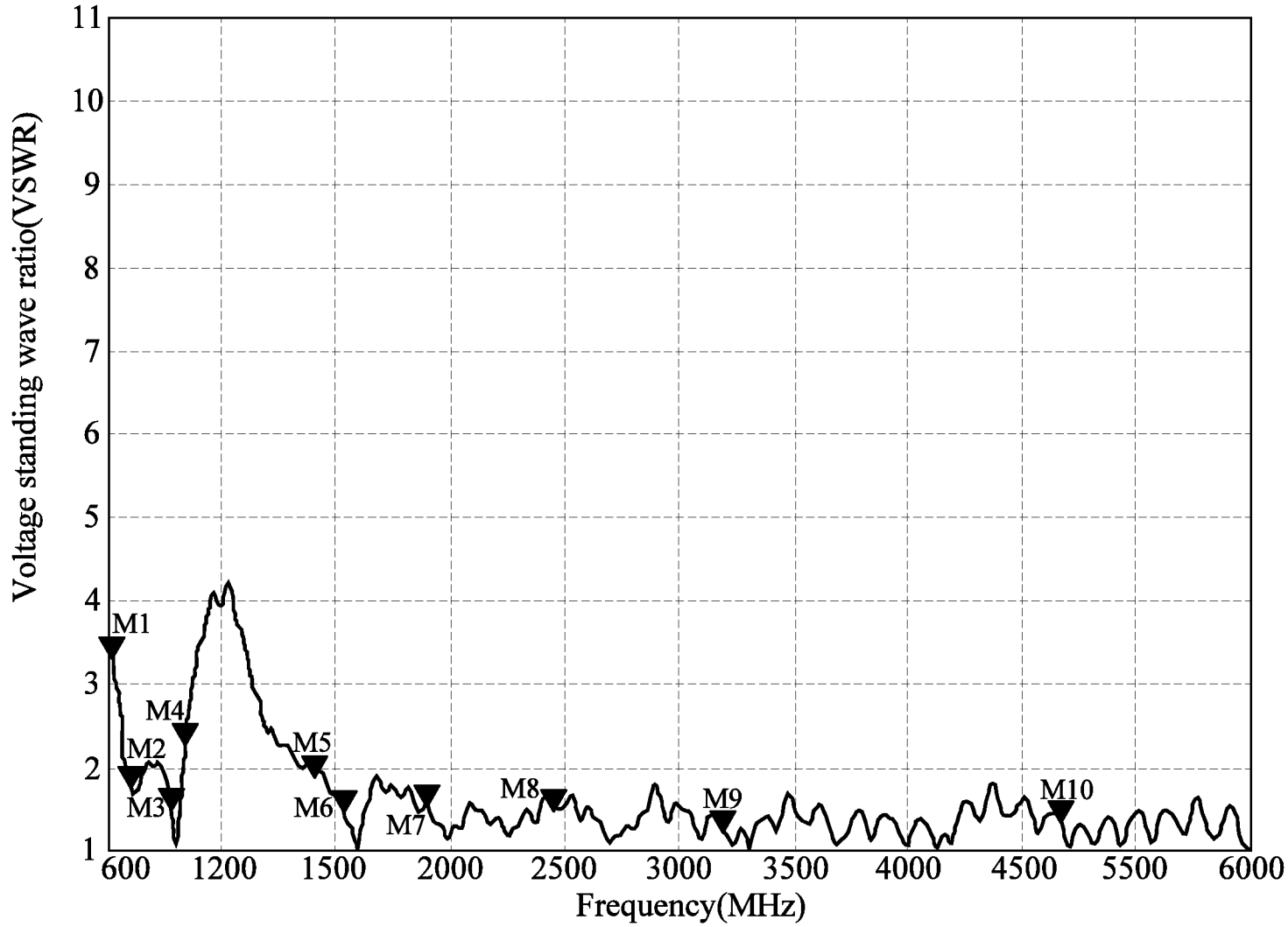
FIG. 5 is a wave diagram of voltage standing wave ratios (VSWR) of the antenna structure in FIG. 4 at different frequencies.

Then, refer to FIG. 4 again, and refer to FIG. 5 and the following Table 1. FIG. 5 is a wave diagram of VSWRs of the antenna structure in FIG. 4 at different frequencies.

TABLE 1

| Node | Frequency (MHz) | VSWR |
|---|---|---|
| M1 | 617 | 3.3002 |
| M2 | 704 | 1.7430 |
| M3 | 894 | 1.4855 |
| M4 | 960 | 2.2632 |
| M5 | 1710 | 1.4721 |

TABLE 1-continued

| Node | Frequency (MHz) | VSWR |
|---|---|---|
| M6 | 1575 | 1.8710 |
| M7 | 2100 | 1.5380 |
| M8 | 2700 | 1.4722 |
| M9 | 3500 | 1.2145 |
| M10 | 5100 | 1.3314 |

Fifth Embodiment

Figure 6:
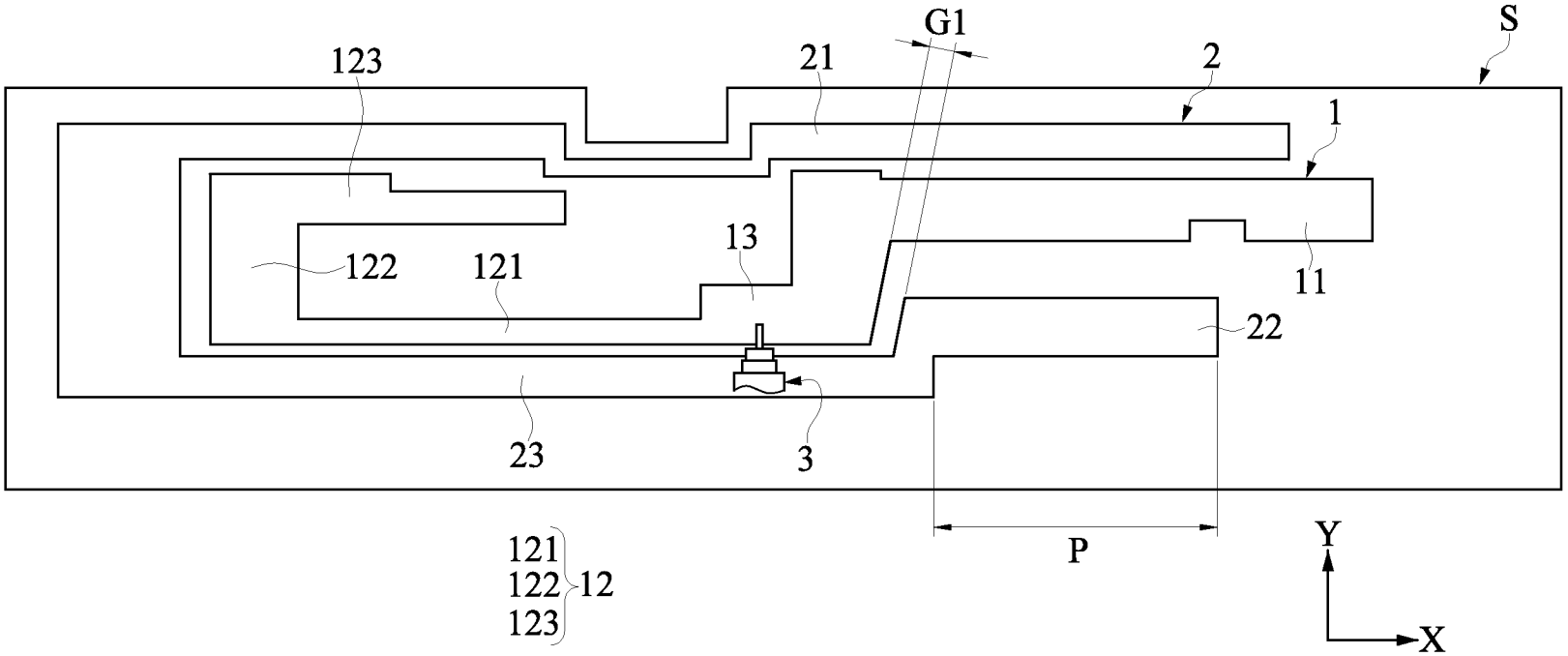
FIG. 6 is a schematic top view of an antenna structure according to a fifth embodiment of the present disclosure.
Figure 7:
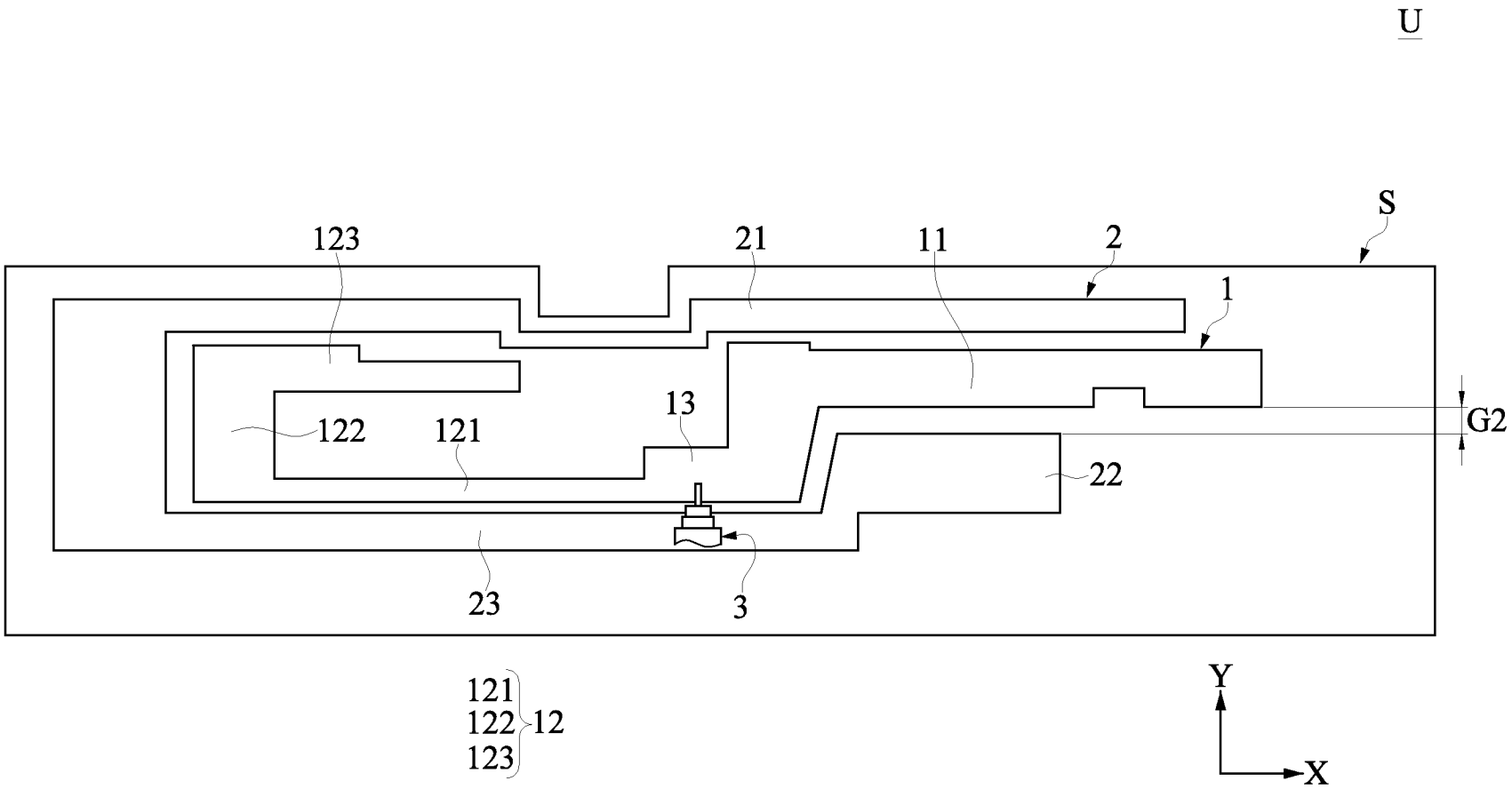
FIG. 7 is another schematic top view of the antenna structure according to the fifth embodiment of the present disclosure.

First, FIG. 6 and FIG. 7 are each a schematic top view of the antenna structure according to the fifth embodiment of the present disclosure. As shown by a comparison between FIG. 6 and FIG. 4 and between FIG. 7 and FIG. 4, a greatest difference between the fifth embodiment and the fourth embodiment lies in that a structure of the fourth radiation portion 22 of the antenna structure U provided in the fifth embodiment may be adjusted, to further improve overall performance of the antenna structure U. In addition, it should be noted that other structural features shown in the fifth embodiment are similar to those described in the foregoing embodiments, and details are not described herein again.

Based on the above, referring to FIG. 6 again, the fourth radiation portion 22 may have a predetermined length P between 11.5 millimeters (mm) and 13 mm, to adjust a center frequency of an operating frequency band having a frequency range between 3,300 MHz and 3,800 MHz, but the present disclosure is not limited thereto. In addition, a first predetermined gap G1 between 1 mm and 2 mm exists between the fourth radiation portion 22 and the feeding portion 13 in a first direction (a positive X direction).

Based on the above, referring to FIG. 7 again, a second predetermined gap G2 between 0.5 mm and 3.5 mm exists between the first radiation portion 11 and the fourth radiation portion 22 in a third direction (a positive Y direction). Preferably, the second predetermined gap G2 may be between 1 mm and 3.5 mm, but the present disclosure is not limited thereto. In other words, a width of the fourth radiation portion 22 may be adjusted, to change a distance of the second predetermined gap G2.

Beneficial Effects of the Embodiments

A beneficial effect of the present disclosure lies in that, in the antenna structure U provided in the present disclosure, a technical solution in which "the fourth radiation portion 22 and the first radiation portion 11 are separate from and coupled to each other" is used to provide an operating frequency band applied to the fifth generation mobile communications technology.

Further, in the antenna structure U provided in the present disclosure, the feeding member 3 can be used to generate an operating frequency band having a frequency range between 698 MHz and 960 MHz, an operating frequency band having a frequency range between 1,450 MHz and 2,300 MHz, and an operating frequency band having a frequency range between 2,300 MHz and 2700 MHz that are applied to 4G Long Term Evolution (LTE). In addition, an operating frequency band that has a frequency range between 5,100 MHz and 5,850 MHz and that is applied to 5G Licensed Assisted Access (LAA) can also be generated. In addition, an operating frequency band that has a frequency range between 3,300 MHz and 3,800 MHz and that is applied to sub 6 GHz in a 5G operating frequency band can also be generated. Therefore, the operating frequency bands applied to the fourth generation mobile communications technology and the fifth generation mobile communications technology can be achieved in a same architecture of the antenna structure U.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a first radiation member, including a first radiation portion, a second radiation portion, and a feeding portion electrically connected between the first radiation portion and the second radiation portion;

a second radiation member, including a third radiation portion, a fourth radiation portion, and a grounding portion electrically connected between the third radiation portion and the fourth radiation portion, wherein the third radiation portion and the first radiation portion are separate from and coupled to each other, the third radiation portion and the second radiation portion are separate from and coupled to each other, and the fourth radiation portion and the first radiation portion are separate from and coupled to each other; and a feeding member, electrically connected between the feeding portion and the grounding portion;

wherein the fourth radiation portion and the first radiation portion are separate from and coupled to each other, to generate an operating frequency band having a frequency range between 3,300 MHz and 3,800 MHz.

2. The antenna structure according to claim 1, wherein the third radiation portion, the grounding portion, and the fourth radiation portion form a surrounding region, and the first radiation member is disposed in the surrounding region.

3. The antenna structure according to claim 1, wherein a connection position between the feeding member and the feeding portion is a feeding position, a first predetermined distance exists between the feeding position and an edge of the grounding portion, and a second predetermined distance exists between the feeding position and an edge of the fourth radiation portion, wherein the second predetermined distance is greater than the first predetermined distance.

4. The antenna structure according to claim 1, wherein the second radiation portion has a first radiation body electrically connected to the feeding portion, a second radiation body electrically connected to the first radiation body and bent relative to the first radiation body, and a third radiation body electrically connected to the second radiation body and bent relative to the second radiation body, wherein the first radiation body has a first predetermined width, the second radiation body has a second predetermined width, and the third radiation body has a third predetermined width, wherein the second predetermined width is greater than the third predetermined width and the third predetermined width is greater than the first predetermined width.

5. The antenna structure according to claim 4, wherein the first radiation portion extends toward a first direction, the first radiation body of the second radiation portion extends toward a second direction, the second radiation body of the second radiation portion extends toward a third direction, the third radiation body of the second radiation portion extends toward the first direction, and the fourth radiation portion extends toward the first direction, wherein the first direction, the second direction, and the third direction are different from one another.

6. The antenna structure according to claim 1, wherein the first radiation portion has a first body, a first protruding body electrically connected to the first body and protruding toward the third radiation portion, and a first groove body recessed relative to the first body.

7. The antenna structure according to claim 1, wherein a first predetermined gap between 1 millimeter (mm) and 2 mm exists between the fourth radiation portion and the feeding portion.

8. The antenna structure according to claim 1, wherein a second predetermined gap between 1 mm and 3.5 mm exists between the first radiation portion and the fourth radiation portion.

9. The antenna structure according to claim 1, wherein the third radiation portion and the second radiation portion are separate from and coupled to each other, and the third radiation portion and the first radiation portion are separate from and coupled to each other, to generate an operating frequency band having a frequency range between 698 MHz and 960 MHz.

10. The antenna structure according to claim 1, wherein the first radiation portion is capable of generating an operating frequency band having a frequency range between 1,450 MHz and 2,300 MHz and an operating frequency band having a frequency range between 5,100 MHz and 5,850 MHz.

11. The antenna structure according to claim 1, wherein the second radiation portion is capable of generating an operating frequency band having a frequency range between 2,300 MHz and 2,700 MHz.

12. The antenna structure according to claim 1, wherein the second radiation portion and the third radiation portion are separate from and coupled to each other, to generate an operating frequency band having a frequency range between 4,600 MHz and 5,400 MHz.

13. An antenna structure, comprising:

a first radiation member, including a first radiation portion, a second radiation portion, and a feeding portion electrically connected between the first radiation portion and the second radiation portion;

a second radiation member, including a third radiation portion, a fourth radiation portion, and a grounding portion electrically connected between the third radiation portion and the fourth radiation portion, wherein the third radiation portion and the first radiation portion are separate from and coupled to each other, the third radiation portion and the second radiation portion are separate from and coupled to each other, and the fourth radiation portion and the first radiation portion are separate from and coupled to each other; and a feeding member, electrically connected between the feeding portion and the grounding portion;

wherein the second radiation portion and the third radiation portion are separate from and coupled to each other, to generate an operating frequency band having a frequency range between 4,600 MHz and 5,400 MHz.

14. An antenna structure, comprising:

a first radiation member, including a first radiation portion, a second radiation portion, and a feeding portion electrically connected between the first radiation portion and the second radiation portion, the second radiation portion has a first radiation body electrically connected to the feeding portion, a second radiation body electrically connected to the first radiation body and bent relative to the first radiation body, and a third radiation body electrically connected to the second radiation body and bent relative to the second radiation body;

a second radiation member, including a third radiation portion, a fourth radiation portion, and a grounding portion electrically connected between the third radiation portion and the fourth radiation portion, wherein the third radiation portion and the first radiation portion are separate from and coupled to each other, the third radiation portion and the second radiation portion are separate from and coupled to each other, and the fourth radiation portion and the first radiation portion are separate from and coupled to each other; and a feeding member, electrically connected between the feeding portion and the grounding portion;

wherein the first radiation portion extends toward a first direction, the first radiation body of the second radiation portion extends toward a second direction, the second radiation body of the second radiation portion extends toward a third direction, the third radiation body of the second radiation portion extends toward the first direction, and the fourth radiation portion extends toward the first direction, wherein the first direction, the second direction, and the third direction are different from one another.

* * * * *